US010186196B2

(12) United States Patent
Sun et al.

(10) Patent No.: US 10,186,196 B2
(45) Date of Patent: Jan. 22, 2019

(54) ARRAY SUBSTRATE AND DISPLAY DEVICE

(71) Applicant: BOE TECHNOLOGY GROUP CO., LTD., Beijing (CN)

(72) Inventors: Tuo Sun, Beijing (CN); Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 213 days.

(21) Appl. No.: 15/112,611

(22) PCT Filed: Jan. 21, 2016

(86) PCT No.: PCT/CN2016/071588

§ 371 (c)(1),
(2) Date: Jul. 19, 2016

(87) PCT Pub. No.: WO2017/008491

PCT Pub. Date: Jan. 19, 2017

(65) Prior Publication Data

US 2018/0166009 A1 Jun. 14, 2018

(30) Foreign Application Priority Data

Jul. 16, 2015 (CN) ..... 2015 1 0419881

(51) Int. Cl.
*G09G 3/3233* (2016.01)
*G09G 3/32* (2016.01)
*G09G 3/20* (2006.01)

(52) U.S. Cl.
CPC ..... *G09G 3/3233* (2013.01); *G09G 3/2007* (2013.01); *G09G 3/32* (2013.01);
(Continued)

(58) Field of Classification Search
CPC .... G09G 3/3233; G09G 3/3241; G09G 3/325; G09G 3/3275; G09G 3/3283
See application file for complete search history.

(56) References Cited

U.S. PATENT DOCUMENTS 6,369,786 B1 4/2002 Suzuki
7,573,444 B2 8/2009 Choi et al.
(Continued)

FOREIGN PATENT DOCUMENTS

CN 1873755 A 12/2006
CN 101079233 A 11/2007
(Continued)

OTHER PUBLICATIONS

China Office Action, Application No. 201510419881.5, dated Feb. 24, 2017, 13 pps.
(Continued)

*Primary Examiner* — Kevin M Nguyen
(74) *Attorney, Agent, or Firm* — Armstrong Teasdale LLP

(57) ABSTRACT

Embodiments of the present disclosure provide an array substrate and a display device, wherein the array substrate includes a plurality of scanning signal lines, a plurality of data lines, a plurality of pixel circuits disposed at intersections between the plurality of scanning signal lines and the plurality of data lines, a current source circuit connected to first ends of the plurality of data lines and configured to output a current to the pixel circuits through the plurality of data lines, and a constant current circuit connected to second ends of the plurality of data lines and configured to supply a current with a preset value flowing from the first ends to the second ends to the data lines. The display device includes the foregoing array substrate.

13 Claims, 5 Drawing Sheets

(52) U.S. Cl.
CPC ..... *G09G 2300/0809* (2013.01); *G09G 2320/0219* (2013.01)

(56) References Cited

U.S. PATENT DOCUMENTS

| | | | | |
|---|---|---|---|---|
| 7,903,053 | B2 | 3/2011 | Kawasaki et al. | |
| 2004/0085029 | A1* | 5/2004 | Kimura | G09G 3/325 315/291 |
| 2006/0132395 | A1 | 6/2006 | Kawasaki et al. | |
| 2006/0139259 | A1 | 6/2006 | Choi et al. | |
| 2013/0162617 | A1* | 6/2013 | Yoon | G09G 3/3291 345/211 |

FOREIGN PATENT DOCUMENTS

| | | | |
|---|---|---|---|
| CN | 104966479 | A | 10/2015 |
| KR | 20070054862 | A | 5/2007 |
| KR | 1020070054862 | A | 5/2007 |

OTHER PUBLICATIONS

English Translation of PCT Written Opinion, Application No. PCT/CN2015/071588, dated Apr. 24, 2016, 6 pps.
International Search Report and Written Opinion, dated Apr. 26, 2016, for co-pending International application No. PCT/CN2016/071588 (14 pgs.).

* cited by examiner

ARRAY SUBSTRATE AND DISPLAY DEVICE

CROSS REFERENCE TO RELATED APPLICATIONS

This application is a National Stage Entry of PCT/CN2016/071588 filed Jan. 21, 2016, which claims the benefit and priority of Chinese Patent Application No. 201510419881.5 filed Jul. 16, 2015, both of which are incorporated herein by reference in their entirety.

BACKGROUND

The present disclosure generally relates to the field of display technologies, and more particularly, to an array substrate and a display device.

In at least some known systems, a current-driving pixel circuit receives a data current outputted by a current source in a data driving circuit to write in a gray scale value. The data current is larger when a larger gray scale value is written in, and the data current is smaller when a smaller gray scale value is written in. In an actual product, it is inevitable to avoid parasitic capacitors formed between data lines for transmitting the foregoing data current and other conductor structures, and the parasitic capacitors may have a great impact on the small data current in the process of writing in a smaller gray scale value. To reduce the impact of the parasitic capacitors of the data lines on the small data current, in the prior art, the data current is generally amplified proportionally by means of pixel circuit design. However, it is required to strictly guarantee a strict amplification scale in this manner, thus the technological requirements it is very high. Furthermore, there is limitation to amplify a data current with a very small original value. Therefore, it is still impossible to thoroughly solve the problem that a small data current in the process of writing in a small gray scale value is susceptible to parasitic capacitors.

BRIEF DESCRIPTION

Embodiments of the present disclosure provide an array substrate and a display device, and can solve a problem that parasitic capacitors of data lines may have a great impact on small data current in the process of writing in a small gray scale value.

According to a first aspect of the present disclosure, there is provided an array substrate, including a plurality of scanning signal lines, a plurality of data lines, a plurality of pixel circuits disposed at intersections between the plurality of scanning signal lines and the plurality of data lines, a current source circuit connected to first ends of the plurality of data lines and configured to output a current to the pixel circuits through the plurality of data lines, and a constant current circuit connected to second ends of the plurality of data lines and configured to supply a current with a preset value flowing from the first ends to the second ends to the plurality of data lines.

In the embodiments of the present disclosure, the constant current circuit includes a first capacitor, wherein a first end of the first capacitor is connected to the second ends of the data lines, and a first transistor, wherein a control electrode of the first transistor is connected to a second end of the first capacitor, a first electrode of the first transistor is connected to the first end of the first capacitor, and a second electrode of the first transistor is connected to a reference voltage line.

In the embodiments of the present disclosure, the constant current circuit further includes a second transistor connected between the first capacitor and the second ends of the data lines, wherein a control electrode of the second transistor is connected to a first control signal line, a first electrode of the second transistor is connected to the second ends of the data lines, and a second electrode of the second transistor is connected to the first end of the first capacitor, and a third transistor connected between the first transistor and the reference voltage line, wherein a control electrode of the third transistor is connected to the first control signal line, a first electrode of the third transistor is connected to the second electrode of the first transistor, and a second electrode of the third transistor is connected to the reference voltage line.

In the embodiments of the present disclosure, the constant current circuit further includes a fourth transistor, wherein a control electrode of the fourth transistor is connected to a second control signal line, a first electrode of the fourth transistor is connected to the first end of the first capacitor, and a second electrode of the fourth transistor is connected to a first bias voltage line, and a fifth transistor, wherein a control electrode of the fifth transistor is connected to the second control signal line, a first electrode of the fifth transistor is connected to the second end of the first capacitor, and a second electrode of the fifth transistor is connected to a second bias voltage line.

In the embodiments of the present disclosure, each of the plurality of pixel circuits is connected to a switch signal line and supplies a bias voltage to a light-emitting device in the pixel circuit under the control of a signal on the switch signal line. A switch signal line corresponding to a pixel circuit closest to the second end of the data line is connected to the first control signal line, and the scanning signal line corresponding to the pixel circuit is connected to the second control signal line.

In the embodiments of the present disclosure, the constant current circuit further includes a sixth transistor, wherein a control electrode of the sixth transistor is connected to a third control signal line, a first electrode of the sixth transistor is connected to the first electrode of the first capacitor and the second electrode of the second transistor, and a second electrode of the sixth transistor is connected to a third bias voltage line, a seventh transistor, wherein a control electrode of the seventh transistor is connected to the third control signal line, a first electrode of the seventh transistor is connected to the second electrode of the first capacitor and the first electrode of the third transistor, and a second electrode of the seventh transistor is connected to the second end of the first capacitor, and an eighth transistor, wherein a control electrode of the eighth transistor is connected to a fourth control signal line, a first electrode of the eighth transistor is connected to the second end of the first capacitor, and a second electrode of the eighth transistor is connected to the reference voltage line.

In the embodiments of the present disclosure, each of the plurality of pixel circuits is connected to a switch signal line and supplies a bias voltage to a light-emitting device in the pixel circuit under the control of a signal on the switch signal line. The scanning signal line corresponding to the pixel circuit closest to the second end of the data line is connected to the third control signal line. The scanning signal line corresponding to the pixel circuit second closest to the second end of the data line is connected to the fourth control signal line.

In the embodiments of the present disclosure, the reference voltage line is configured to supply a predetermined reference voltage to the second electrode of the first transistor so that the first transistor works within a saturation region.

In the embodiments of the present disclosure, the pixel circuit includes a second capacitor, a light-emitting device, wherein a second end of the light-emitting device is connected to a fifth bias voltage line, a ninth transistor, wherein a control electrode of the ninth transistor is connected to the scanning signal line, a first electrode of the ninth transistor is connected to the data line, and a second electrode of the ninth transistor is connected to a first end of the second capacitor, a tenth transistor, wherein a control electrode of the tenth transistor is connected to a switch signal line, a first electrode of the tenth transistor is connected to a fourth bias voltage line, and a second electrode of the tenth transistor is connected to the first end of the second capacitor, an eleventh transistor, wherein a control electrode of the eleventh transistor is connected to the scanning signal line, a first electrode of the eleventh transistor is connected to an initial voltage signal line, and a second electrode of the eleventh transistor is connected to a second end of the second capacitor; and a twelfth transistor, where a control electrode of the twelfth transistor is connected to the second end of the second capacitor, a first electrode of the twelfth transistor is connected to the first end of the second capacitor, and a second electrode of the twelfth transistor is connected to a first end of the light-emitting device.

According to a second aspect of the present disclosure, there is provided a display device which includes any one of the foregoing array substrates.

It can be seen from the above technical solutions that in the embodiments of the present disclosure, a constant current circuit is disposed in the array substrate, so that a preset constant background current exists on data lines transmitting the data current for the pixel circuits. The magnitude of the current written into the pixel circuits in the process of writing in a gray scale value is increased with a preset value, thereby reducing impact of the parasitic capacitors of the data lines on the process of writing in the gray scale value. Therefore, it solves the problem that in the process of writing in a small gray scale value, the small data current is susceptible to parasitic capacitors of the data lines. Further, the embodiments of the present disclosure may be implemented by means of simple structure addition or modification on the basis of existing schemes, and added power dissipation may merely amount to a sum (approximately a few tenths of a milliwatt) of the power dissipation of a few rows of pixel circuits, which may not affect the overall power dissipation and the cost of a product.

BRIEF DESCRIPTION OF THE DRAWINGS

To describe the technical solutions in the embodiments of the present disclosure or in the prior art more clearly, the following will briefly introduce the accompanying drawings required for describing the embodiments or the prior art. Apparently, the accompanying drawings in the following description show merely some embodiments of the present disclosure, and a person of ordinary skill in the art may still derive other drawings from these accompanying drawings without creative efforts.

DETAILED DESCRIPTION

To make the advantages of the embodiments of the present disclosure clearer, the following clearly and completely describes the technical solutions in the embodiments of the present disclosure with reference to the accompanying drawings in the embodiments of the present disclosure. Apparently, the described embodiments are some but not all of the embodiments of the present disclosure. All other embodiments obtained by a person of ordinary skill in the art based on the embodiments of the present disclosure without creative efforts shall fall within the protection scope of the present disclosure.

Figure 1:
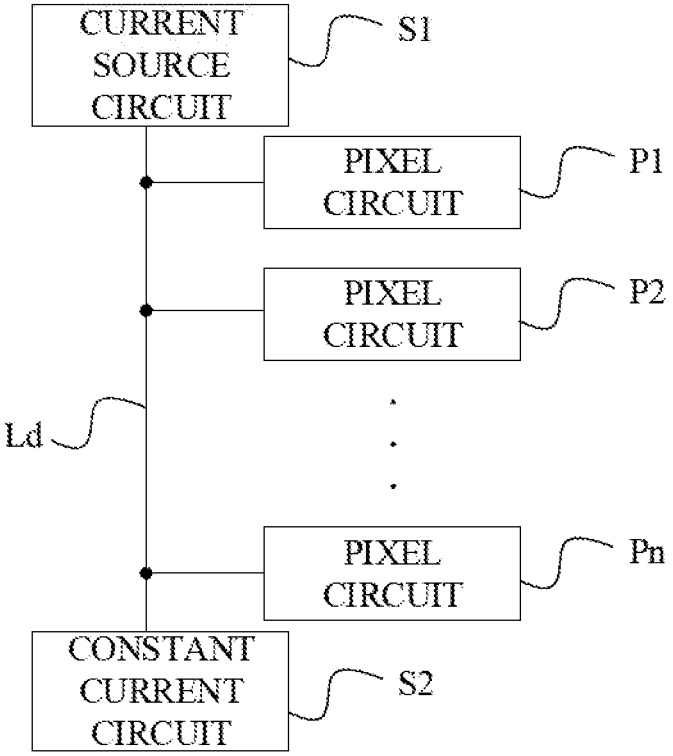
FIG. 1 is a structural block diagram of a local circuit on an array substrate according to a first embodiment of the present disclosure.

FIG. 1 is a structural block diagram of a local circuit on an array substrate according to a first embodiment of the present disclosure. The array substrate includes a plurality of pixel circuits distributed in a plurality of rows and a plurality of columns (FIG. 1 shows a group of pixel circuits P1, P2, . . . Pn distributed in one column as an example), data lines, a current source circuit and a constant current circuit. Referring to FIG. 1, each of the pixel circuits P1, P2, . . . Pn among the multiple pixel circuits is separately connected to the data line Ld. As shown in FIG. 1, the data line Ld has a plurality of connection nodes separately connected to the pixel circuits P1, P2, . . . Pn, and the data line Ld has a first end and a second end. The current source circuit S1 is connected to the first end of the data lines Ld, and the constant current circuit S2 is connected to the second end of the data line Ld. The current source circuit S1 is configured to output, to any one of the pixel circuits P1, P2, . . . Pn among the multiple pixel circuits, a current correspondingly through the data line Ld. The constant current circuit S2 is configured to supply current with a preset value to the data line Ld. In FIG. 1, the constant current circuit S2 supplies a current with a preset magnitude flowing from the first end to the second end of the data line Ld.

Figure 2:
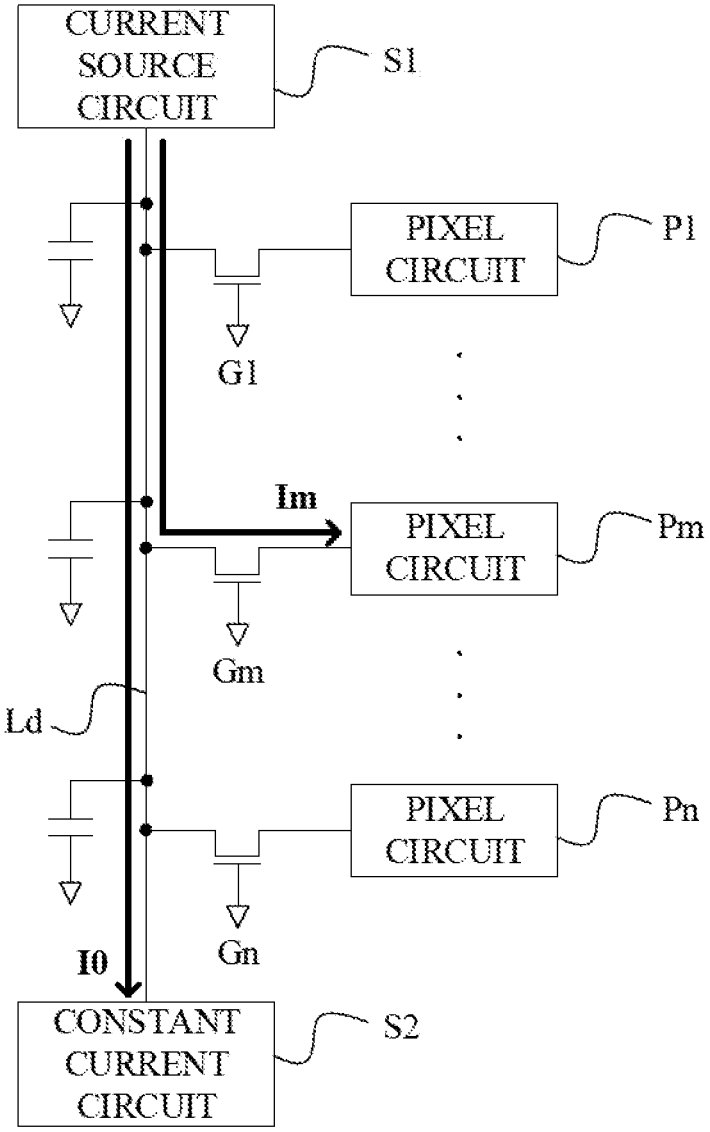
FIG. 2 is a schematic diagram of working principle of the array substrate under an operating state according to the embodiment as shown in FIG. 1.

FIG. 2 is a schematic diagram of working principle of the array substrate under an operating state according to the embodiment as shown in FIG. 1. Referring to FIG. 2, to any pixel circuit Pm ($1 \leq m \leq n$) among the pixel circuits P1, P2, . . . Pn, the current source circuit S1 may output current Im to the pixel circuit Pm through the data line Ld. The constant current circuit S2 may supply current I0 flowing from the first end to the second end of the data line Ld, and the magnitude of the current I0 is locked to be a preset value.

FIG. 2 further shows transistors configured to control the current source circuit S1 to output current to a certain pixel circuit, wherein a gate electrode of the transistor (G1, . . . , Gm, . . . Gn as shown in FIG. 2) is connected to a control signal line, and a source electrode and a drain electrode of the transistor are respectively connected to the data line and the pixel circuit. Specifically, when a transistor corresponding to a certain pixel circuit is turned on under the control of a control signal received by the gate electrode, the current source circuit S1 may output corresponding current to the pixel circuit through the data line Ld. By adjusting the settings of the control signal, the current source circuit S1 may output in sequence corresponding current to each pixel circuit. It is to be understood that it is merely an example to implement this control by using a transistor, and this control may also be implemented by using other structures with a similar switch function, to which the present disclosure does not limit. The transistor may also be disposed inside the pixel circuit and function as a part of the pixel circuit.

In FIG. 2, a plurality of capacitors represent parasitic capacitors formed between the data line and other structures in the array substrate, wherein one end of the capacitor is connected to the data line Ld. Due to presence of the parasitic capacitors, current outputted by the current source circuit S1 may also charge up the parasitic capacitors. The larger the capacitance values of the parasitic capacitors are, and/or the smaller the current outputted by the current source circuit S1 is, the greater the impact of the parasitic capacitors on the current outputted by the current source circuit S1 to the pixel circuit is.

Figure 3:
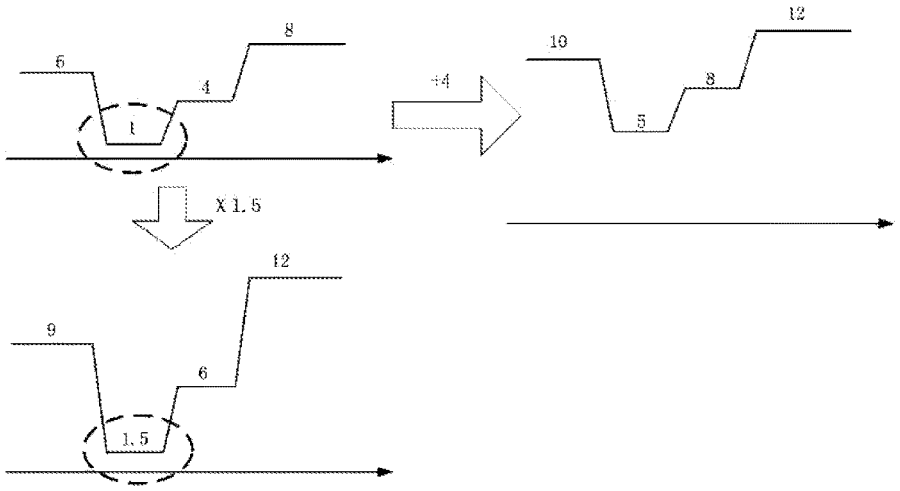
FIG. 3 is a schematic diagram showing an effect contrast between the array substrate according to the embodiment as shown in FIG. 1 and an array substrate in the prior art in terms of enhancing the data current.

FIG. 3 is a schematic diagram showing an effect contrast between the array substrate according to the embodiment as shown in FIG. 1 and an array substrate of the prior art in terms of enhancing data current. Referring to FIG. 3, the current source circuit S1 separately outputs four currents whose relative magnitudes are 6, 1, 4 and 8 respectively (numerals in FIG. 3 signify relative magnitudes of the currents). In the prior art, generally current is amplified proportionally by means of an amplifying circuit or the like in a pixel circuit. For example, in FIG. 3, after being amplified by a factor of 1.5, the relative magnitudes of the four currents become 9, 1.5, 6 and 12 respectively. Since a value of an amplified current is limited, an amplification ratio cannot be set too large in this manner so that this manner has a limited amplification effect on a small current. For example, to currents with relative magnitudes of "1" and "1.5" marked by dotted boxes in FIG. 3, the currents after being amplified are still very small, and the problem caused by parasitic capacitors still exists.

In contrast, referring to FIG. 2, in the embodiments of the present disclosure, the constant current circuit S2 keeps current I0 with a preset magnitude in existence on the data line. Parasitic capacitors formed between the data line and other structures may be charged up mainly by the current I0. Therefore, the embodiments of the present disclosure can reduce impact of the parasitic capacitors on the current Im. For example, in FIG. 3, supposing the relative magnitude of I0 is 4, the magnitude of total current on the data line amounts to the sum of Im and I0, namely, changing from the original 6, 1, 4 and 8 to 10, 5, 8 and 12, so that when a current Im with any magnitude is outputted to a pixel circuit Pm, the total current I0+Im on the data line is large enough and is not affected by the parasitic capacitors formed between the data line and other structures.

Also it can be seen that the magnitude of the added current I0 amounts to the data current of a pixel circuit in magnitude. Since each group of pixels distributed into one column merely requires one current I0, the added current is merely equal to I0 multiplied by the number of columns of pixels even though the whole array substrate adopts such a design. In other words, increased power dissipation amounts to power dissipation (approximately a few tenths of a milliwatt) of one row of pixels or at most several rows of pixels, which does not affect the overall power dissipation of a product.

As can be seen, in the embodiments of the present disclosure, a constant current circuit is disposed in the array substrate, so that a preset constant background current exists on the data line transmitting the data current for pixel circuits, a current value written into a pixel circuit is increased with a preset magnitude in a process of writing in a gray scale value, thereby reducing impact of parasitic capacitors of the data lines on the process of writing in the gray scale value. Therefore, it solves the problem that in the process of writing in a small gray scale value, the small data current is susceptible to the parasitic capacitors. Further, the embodiments of the present disclosure may be implemented by means of simple structure addition or modification on the basis of existing schemes, and added power dissipation may merely amount to sum (approximately a few tenths of a milliwatt) of power dissipation of a few rows of pixel circuits, which may not affect the overall power dissipation and cost of a product.

To more clearly describe alternative embodiments of the present disclosure, the following provides several examples of a specific circuit structure of the constant current circuit.

Figure 4:
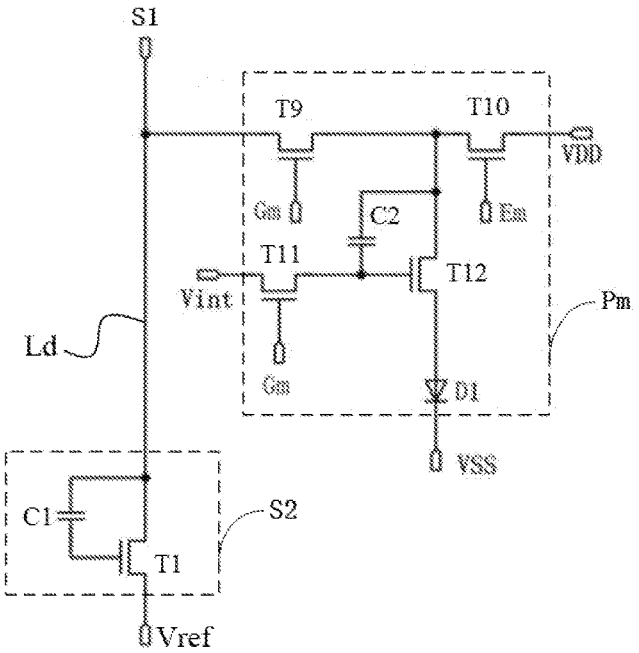
FIG. 4 is a schematic circuit diagram of a constant current circuit and a pixel circuit in the array substrate according to the embodiment as shown in FIG. 1.

FIG. 4 is a schematic circuit diagram of a constant current circuit and a pixel circuit in the array substrate according to the embodiment as shown in FIG. 1. Referring to FIG. 4, the constant current circuit S2 includes a first capacitor C1 and a first transistor T1, where a first end of the first capacitor is connected to the second end of the data line Ld, the gate electrode of the first transistor T1 is connected to a second end of the first capacitor C1, either one of the source electrode and the drain electrode is connected to a first end of the first capacitor C1, and the other one is connected to a reference voltage line Vref.

It is to be understood that the transistor may be N-type or P-type transistor. Those skilled in the art may select connection mode of source electrode and drain electrode according to the specific type of the transistor, to which the present disclosure does not limit. For example, the first transistor T1 may be an N-type thin film transistor (TFT), the electrode connected to the data line Ld may be the source electrode of the first transistor T1, and the electrode connected to the reference voltage line Vref may be the drain electrode of the first transistor T1. It is also to be understood that the reference voltage line Vref is configured to supply a preset voltage to the constant current circuit S2. Specifically, the reference voltage line Vref may be configured to supply a predetermined reference voltage to the source electrode or drain electrode of the first transistor T1 so that the first transistor works within a saturation region. Of course, the reference voltage line Vref may be substituted by other circuit structures with the equivalent function, to which the present disclosure does not limit.

In the circuit in this embodiment, gate-source voltage of the first transistor T1 in the constant current circuit S2 is locked by the first capacitor C1, so that the first transistor T1 may work within a saturation region in coordination with the reference voltage line Vref. Therefore, the current flowing from the first transistor T1 to the reference voltage line Vref through the data line Ld is stabilized at a value exact enough. The constant current circuit S2 supplies the current with a preset magnitude flowing from the first end to the second end of the data line Ld.

As can be seen, the constant current circuit S2 in this embodiment has an extremely simple circuit structure, may be fabricated inside a peripheral circuit of the existing array substrate and together with the peripheral circuit simultaneously by means of an existing technology, neither occupying too much space nor increasing new manufacturing steps, thereby being advantageous to reducing cost.

FIG. 4 further shows a schematic circuit diagram of a pixel circuit. Referring to FIG. 4, herein the pixel circuit Pm specifically includes a second capacitor C2, a light-emitting device D1, a ninth transistor T9, a tenth transistor T10, an eleventh transistor T11 and a twelfth transistor T12. The second end of the light-emitting device D1 is connected to a fifth bias voltage line VSS. The gate electrode of the ninth transistor T9 is connected to a scanning signal line Gm, either one of the source electrode and the drain electrode is connected to the data lines Ld, and the other one is connected to the first end of the second capacitor C2. The gate electrode of the tenth transistor T10 is connected to a switch signal line Em, either one of the source electrode and the drain electrode is connected to the fourth bias voltage line VDD, and the other one is connected to the first end of the second capacitor C2. The gate electrode of the eleventh transistor T11 is connected to the scanning signal line Gm, either one of the source electrode and the drain electrode is connected to an initial voltage signal line Vint, and the other one is connected to the second end of the second capacitor C2. The gate electrode of the twelfth transistor T12 is connected to the second end of the second capacitor C2, either one of the source electrode and the drain electrode is connected to the first end of the second capacitor C2, and the other one is connected to the first end of the light-emitting device D1.

It should be noted that the light-emitting device D1 may be a light-emitting diode, for example, an organic light emitting diode (OLED). When the light-emitting device D1 is an OLED, the luminous intensity of the light-emitting device D1 is mainly related to current flowing through two ends thereof.

Figure 5:
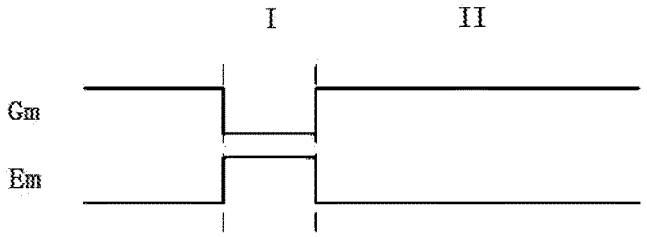
FIG. 5 is a timing chart of the pixel circuit as shown in FIG. 4.

FIG. 5 is a timing chart of the pixel circuit as shown in FIG. 4. Referring to FIG. 4 and FIG. 5, in Phase I, under the action of a signal on the scanning signal line Gm, T9 and T11 are turned on, the current Im outputted by the current source circuit S1 reaches the first end of the second capacitor C2 through the source electrode and the drain electrode of T9, and the voltage at the second end of the second capacitor C2 is set to the voltage on Vint so that the gate-source voltage of T12 is saved in the second capacitor C2. In Phase II, under the action of a signal on the switch signal line Em, T10 is turned on, T9 and T11 are turned off, and a current may be formed between VDD and VSS. Whereas at the moment, the gate-source voltage of T12 has been locked by the second capacitor C2, and thus T12 may supply a stable current (the magnitude thereof is related to Im and the voltage of Vint) to the light-emitting device D1 so that D1 emits light under the action of the current. As can be seen, the magnitude of the current Im determines the magnitude of the current finally driving D1 to emit light. However, affected by parasitic capacitors of the data line Ld, the magnitude of current Im may be changed, which makes the voltage across C2 deviate, thereby having a negative effect on light emission of D1 in Phase II. However, since the constant current circuit S2 connected to the second end of the data line Ld may supply a background current I0 on the data line Ld, the impact of the parasitic capacitors connected to the data line Ld to the voltage across C2 may be reduced, and then the negative effect on light emission of D1 is reduced.

It is to be understood that the structure of a pixel circuit as shown in FIG. 4 is merely an example, and those skilled in the art may implement the light emission drive for the light-emitting device D1 in other ways with reference to the prior art, to which the present disclosure does not limit.

Furthermore, it is to be inferred that the scanning signal line Gm (G1, G2, . . . , Gn in other pixel circuits) used for controlling current Im to flow in and the switch signal line Em (E1, E2, . . . , En in other pixel circuits) used for controlling VDD to be inputted are structures needed to be disposed for a majority of pixel circuits. Based on this, a circuit timing sequence of the pixel circuit may be combined to implement control of the constant current circuit S2, and in the embodiments of the present disclosure, this manner for implementing control of the constant current circuit S2 by combining the circuit timing sequence of a pixel circuit has universal applicability, and is not limited to the pixel circuit as shown in the figures.

Figure 6:
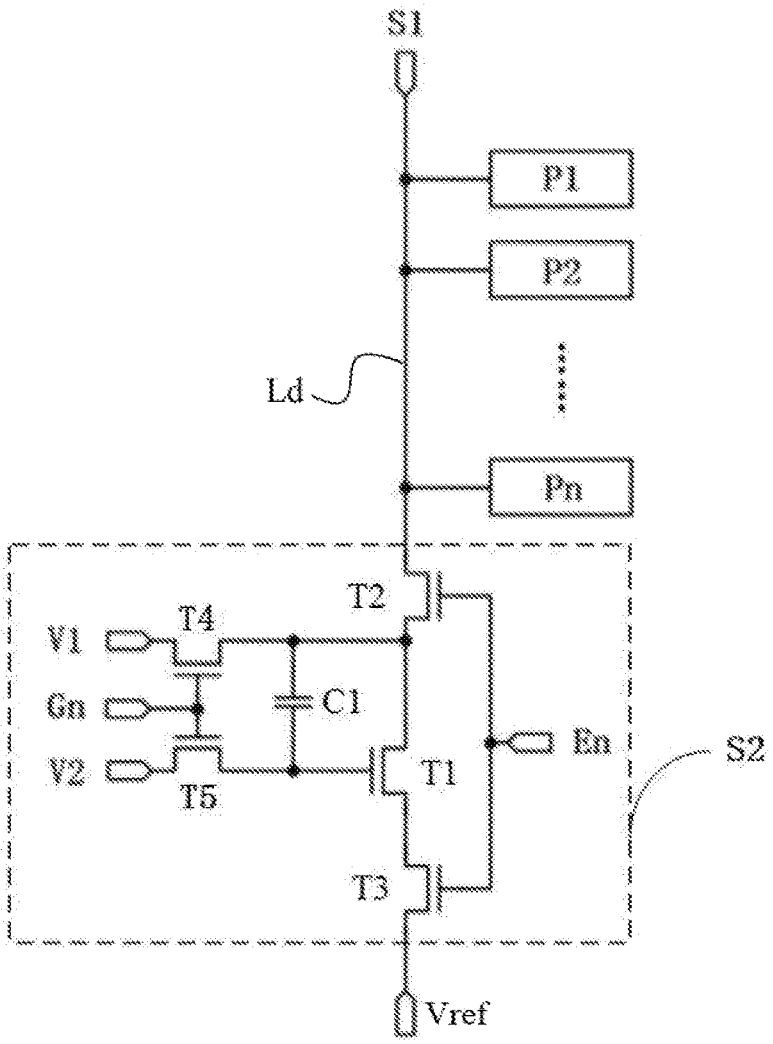
FIG. 6 is a schematic circuit diagram of a constant current circuit in an array substrate according to a second embodiment of the present disclosure.

FIG. 6 is a schematic circuit diagram of a constant current circuit in an array substrate according to a second embodiment of the present disclosure. Referring to FIG. 6, on the basis of the structure of the constant current circuit S2 as shown in FIG. 4, the constant current circuit S2 as shown in FIG. 6 further includes a second transistor T2 between the first end of the first capacitor C1 and the second end of the data line Ld, and further includes a third transistor T3 between the reference voltage line Vref and the source/drain electrode of the first transistor T1. Specifically, gate electrodes of the second transistor T2 and the third transistor T3 are connected to the first control signal line (as an example, the first control signal line in FIG. 6 is a control signal line connected to the switch signal line En of the pixel circuit Pn, and the pixel circuit Pn is a pixel circuit closest to the second end of the data line Ld). Either one of the source electrode and the drain electrode of the second transistor T2 is connected to the second end of the data line Ld, and the other one is connected to the first end of the first capacitor C1. Either one of the source electrode and the drain electrode of the third transistor T3 is connected to the source electrode or drain electrode of the first transistor T1, and the other one is connected to the reference voltage line Vref. Based on the above description, a signal on the first control signal line may control T2 and T3 to be simultaneously turned on or off so as to control the constant current circuit S2 to switch between an operating state and a non-operating state.

Further, the constant current circuit S2 as shown in FIG. 6 further includes a fourth transistor T4 and a fifth transistor T5. Gate electrodes of the fourth transistor T4 and the fifth transistor T5 are connected to the second control signal line (as an example, the second control signal line in FIG. 6 is a control signal line connected to the scanning signal line Gn of the pixel circuit Pn). Either one of the source electrode and the drain electrode of the fourth transistor T4 is connected to the first end of the first capacitor C1, and the other one is connected to a first bias voltage line V1. Either one of the source electrode and the drain electrode of the fifth transistor is connected to the second end of the first capacitor C1, the other one is connected to a second bias voltage line V2. As can be seen, when the signal on the second control signal line makes T4 and T5 be turned on and the signal on the first control signal line makes T2 and T3 be turned off, the voltages at the two ends of C1 may be respectively set to the voltage of V1 and the voltage of V2. Thus, on the basis of this structure, settings of V1 and V2 may be employed to implement control of the voltages at the two ends of C1, and then to implement the control of the current I0 supplied by the constant current circuit S2.

More specifically, a plurality of pixel circuits may be arranged into a plurality of rows and a plurality of columns on the array substrate, and the same group of pixel circuits is positioned in the same column. At the moment, each pixel circuit is also connected to a scanning signal line, and the pixel circuit is configured to receive, under the control of a signal on the scanning signal line, a current outputted by the current source circuit. Each pixel circuit is also connected to a switch signal line, and the pixel circuit is also configured to supply a bias voltage to a light-emitting device in the pixel circuit under the control of the signal on the switch signal line. Based on this, a plurality of rows of scanning signal lines and a plurality of columns of data lines on the array substrate may cooperate to implement the progressive scanning and driving of the pixel circuits. On this basis, the first control signal line is connected to a switch signal line En corresponding to a row of pixel circuits in which the pixel circuit Pn closest to the second end of the data line Ld is, and the second control signal line is connected to the scanning signal line Gn corresponding to this row of pixel circuits, as shown in FIG. 6. Based on this, when a scanning signal of pixel circuits in a last row (a signal on the scanning signal line Gn for this row) where the pixel circuit Pn is arrives, the voltages at the two ends of C1 may be set according to the foregoing process; and when a switch signal of this row of pixel circuits (a signal on the scanning signal line En for this row) arrives, T2 and T3 may be turned on, and T4 and T5 may be turned off, so that background current controlled by voltage across C1 is formed on the data line for the next frame of picture, thereby implementing resetting of background current for each frame.

Figure 7:
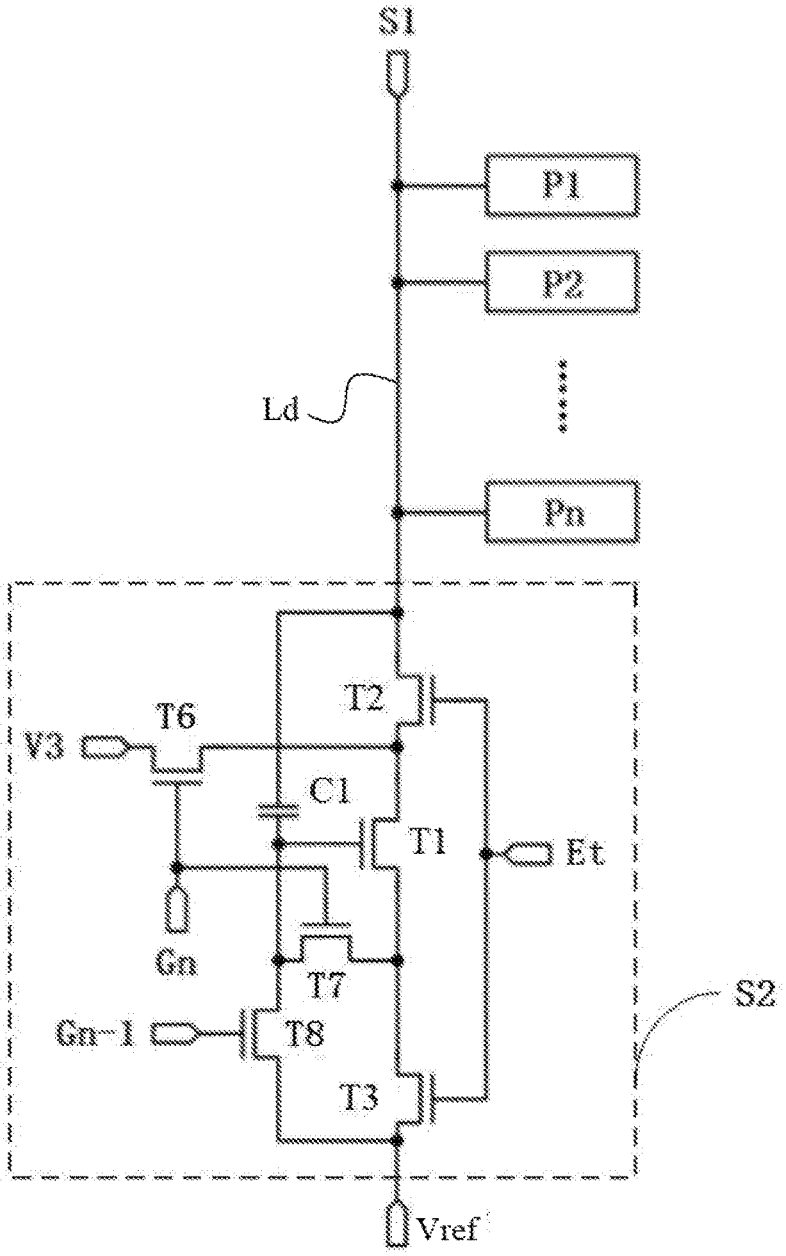
FIG. 7 is a schematic circuit diagram of a constant current circuit in an array substrate according to a third embodiment of the present disclosure.

FIG. 7 is a schematic circuit diagram of a constant current circuit in an array substrate according to a third embodiment of the present disclosure. Referring to FIG. 7, the constant current circuit S2 includes the first transistor T1, the first capacitor C1, the second transistor T2 and the third transistor T3, and further includes a sixth transistor T6, a seventh transistor T7 and an eighth transistor T8. Gate electrodes of the sixth transistor T6 and the seventh transistor T7 are connected to a third control signal line (as an example, the third control signal line in FIG. 7 is a control signal line connected to the scanning signal line Gn for the pixel circuit Pn), either one of the source electrode and the drain electrode of the sixth transistor T6 is connected to a connection point between the first transistor T1 and the second transistor T2 (namely, connected to a first electrode of the first transistor T1 and a second electrode of the second transistor T2), and the other one is connected to a third bias voltage line V3. Either one of the source electrode and the drain electrode of the seventh transistor T7 is connected to a connection point between the first transistor T1 and the third transistor T3 (namely, connected to a second electrode of the first transistor T1 and a first electrode of the third transistor T3), and the other one is connected to the second end of the first capacitor C1. The gate electrode of the eighth transistor T8 is connected to a fourth control signal line (as an example, the fourth control signal line in FIG. 7 is a control signal line connected to a scanning signal line Gn−1 for the pixel circuit Pn−1, and the pixel circuit Pn−1 is the pixel circuit second closest to the second end of the data line Ld), either one of the source electrode and the drain electrode is connected to the second end of the first capacitor C1, and the other one is connected to the reference voltage line Vref.

Furthermore, in this embodiment, the signal on the first control signal line connected to the gate electrodes of the second transistor T2 and the third transistor T3 is a signal related to the signal on the third control signal line and the signal on the fourth control signal line. Specifically, a signal at Et in FIG. 7 may be a signal obtained by inverting the sum of a signal at Gn and a signal at Gn−1. Based on this, at the same time when a signal at Gn−1 arrives, under the action of a signal at Et, T2 and T3 are turned off whereas T8 is turned on, and the electric potential at the second end of the first capacitor C1 and the electric potential of the gate electrode of the first transistor T1 are set to the voltage on Vref. Then at the same time when a signal at Gn arrives, under the action of the signal at Et, T2 and T3 are still simultaneously turned off, at the moment T6 and T7 are turned on, so that either one of the source electrode and the drain electrode of T1 is applied with the voltage at V3, and the other one is connected to the gate electrode of T1. Thus, T1 is in a diode connection mode, the voltage at V3 may charge up the second end of the first capacitor C1 through T1, and the threshold voltage of the first transistor T1 is written in. Thus, the voltage at the second end of the first capacitor C1 carries the information of the threshold voltage of the first transistor T1, and when the voltage stored in the first capacitor C1 is utilized to control the first transistor T1 to generate a current, the impact of the threshold voltage of the first transistor T1 on the current will be eliminated. Therefore, the magnitude of the current locked by the constant current circuit S2 is unrelated to the threshold voltage of T1, and the compensation of the threshold voltage of T1 may be implemented based on this manner.

Likewise, a plurality of pixel circuits may be arranged into a plurality of rows and a plurality of columns on the array substrate, and the pixel circuits in the same group are positioned in the same column. At the moment, each pixel circuit is also connected to a scanning signal line, and the pixel circuit is configured to receive, under the control of a signal on the scanning signal line, the current outputted from the current source circuit. Each pixel circuit is also connected to a switch signal line, and the pixel circuit is also configured to supply a bias voltage to a light-emitting device in the pixel circuit under the control of a signal on the switch signal line. Based on this, a plurality of rows of scanning signal lines and a plurality of columns of data lines on the array substrate may cooperate to implement progressive scanning and driving of the pixel circuit. On this basis, the third control signal line may be connected to the scanning signal line Gn for a row of pixel circuits in which the pixel circuit Pn closest to the second end of the data line Ld is. The fourth control signal line is connected to the scanning signal line Gn−1 for a row of pixel circuits in which the pixel circuit Pn−1 (namely, the pixel circuit Pn−1 upper to the pixel circuit Pn) second closest to the second end of the data line Ld is. According to the embodiments of the present disclosure, the data line Ld for each column may regather and store the threshold voltage of the first transistor T1 at the end of scanning for a frame, and guarantee that in a next frame, the current supplied by the constant current circuit S2 to the data line for each column is not affected by the threshold voltage of the first transistor T1.

Based on the same inventive concept, the embodiments of the present disclosure further provide a display device, which includes any one of the foregoing array substrates. It should be noted that the display device in this embodiment may be any product or component with display function, such as a display panel, electronic paper, a mobile phone, a tablet computer, a TV set, a notebook computer, a digital photo frame, a navigation device and so on. For example, the display device may be an active-matrix organic light emitting diode (AMOLED) display device, in which the pixel circuit structure may be set as shown in FIG. 4, utilizing an organic light emitting diode as a light-emitting device. Since the display device includes any one of the foregoing array substrates, it may solve the same technical problems and achieve similar technical effects.

It should be noted that in the description of the present disclosure, the orientations or positions represented by the terms of "up", "down" and the like are based on the orientations or positions in the accompanying drawings, they are merely for an easy description of the present disclosure and a simplified description, but not intended to indicate or imply the device or element to have a special orientation or to be configured and operated in a particular orientation. Thus, they cannot be understood as a limit to the present disclosure. Unless specified or limited otherwise, terms "mount", "connect" and "connection" should be understood in a broad sense. For example, they may be used to describe a fixed connection, or a dismountable connection or an integral connection; they may be used to describe a mechanical connection, or an electrical connection; they may be used to describe direct connection or connection by intermediate medium, or communication between interiors of two elements. The specific significations of the above terms in the present disclosure may be understood in the specific context by persons of ordinary skill in the art.

Further it should be noted that a relational term (such as a first or a second . . . ) is merely intended to separate one entity or operation from another entity or operation instead of requiring or hinting any practical relation or sequence exists among these entities or operations. For example, a first electrode of a transistor may be either one of a source electrode and a drain electrode, and a second electrode is another one of the source electrode and the drain electrode. To different transistors, first electrodes may refer to identical electrodes or refer to different electrodes, and second electrodes may refer to identical electrodes or refer to different electrodes. Furthermore, terms such as "comprise", "include" or other variants thereof are intended to cover a non-exclusive "include" so that a process, a method, a merchandise or a device comprising a series of elements not only includes these elements, but also includes other elements not listed explicitly, or also includes inherent elements of the process, the method, the merchandise or the device. In the case of no more restrictions, elements defined by a sentence "include a . . . " do not exclude the fact that additional identical elements may exist in a process, a method, a merchandise or a device of these elements.

The foregoing embodiments are merely intended for describing the technical solutions of the present disclosure, but not for limiting the present disclosure. Although the present disclosure is described in detail with reference to the foregoing embodiments, persons ordinary skilled in the art should understand that they may still make modifications to the technical solutions recorded in the foregoing embodiments or make equivalent substitutions to some technical features thereof; and these modifications or substitutions do not make the essences of corresponding technical solutions depart from the spirit and scope of the technical solutions of the embodiments of the present disclosure.

What is claimed is:

1. An array substrate comprising:

a plurality of scanning signal lines;

a plurality of data lines;

a plurality of pixel circuits disposed at intersections between the plurality of scanning signal lines and the plurality of data lines;

a current source circuit connected to first ends of the plurality of data lines and configured to output a current to the pixel circuits through the plurality of data lines; and a constant current circuit connected to second ends of the plurality of data lines and configured to supply a current with a preset value flowing from the first ends to the second ends to the plurality of data lines, wherein the constant current circuit comprises:

a first capacitor, wherein a first end of the first capacitor is connected to the second ends of the data lines;

a first transistor, wherein a control electrode of the first transistor is connected to a second end of the first capacitor, a first electrode of the first transistor is connected to the first end of the first capacitor, and a second electrode of the first transistor is connected to a reference voltage line;

a second transistor connected between the first capacitor and the second ends of the data lines, wherein a control electrode of the second transistor is connected to a first control signal line, a first electrode of the second transistor is connected to the second ends of the data lines, and a second electrode of the second transistor is connected to the first end of the first capacitor; and a third transistor connected between the first transistor and the reference voltage line, wherein a control electrode of the third transistor is connected to the first control signal line, a first electrode of the third transistor is connected to the second electrode of the first transistor, and a second electrode of the third transistor is connected to the reference voltage line.

2. The array substrate according to claim 1, wherein the constant current circuit further comprises;

a fourth transistor, wherein a control electrode of the fourth transistor is connected to a second control signal line, a first electrode of the fourth transistor is connected to the first end of the first capacitor, and a second electrode of the fourth transistor is connected to a first bias voltage line; and a fifth transistor, wherein a control electrode of the fifth transistor is connected to the second control signal line, a first electrode of the fifth transistor is connected to the second end of the first capacitor, and a second electrode of the fifth transistor is connected to a second bias voltage line.

3. The array substrate according to claim 2, wherein each of the plurality of pixel circuits is connected to a switch signal line and supplies a bias voltage to a light-emitting device in the pixel circuit under the control of a signal on the switch signal line; and wherein the switch signal line corresponding to the pixel circuit closest to the second end of the data line is connected to the first control signal line, and the scanning signal line corresponding to the pixel circuit is connected to the second control signal line.

4. The array substrate according to claim 2, wherein the reference voltage line is configured to supply a predetermined reference voltage to the second electrode of the first transistor so that the first transistor works within a saturation region.

5. The array substrate according to claim 3, wherein the reference voltage line is configured to supply a predetermined reference voltage to the second electrode of the first transistor so that the first transistor works within a saturation region.

6. The array substrate according to claim 1, wherein the constant current circuit further comprises:

a sixth transistor, wherein a control electrode of the sixth transistor is connected to a third control signal line, a first electrode of the sixth transistor is connected to the first electrode of the first capacitor and the second electrode of the second transistor, and a second electrode of the sixth transistor is connected to a third bias voltage line;

a seventh transistor, wherein a control electrode of the seventh transistor is connected to the third control signal line, a first electrode of the seventh transistor is connected to the second electrode of the first capacitor and the first electrode of the third transistor, and a second electrode of the seventh transistor is connected to the second end of the first capacitor; and an eighth transistor, wherein a control electrode of the eighth transistor is connected to a fourth control signal line, a first electrode of the eighth transistor is connected to the second end of the first capacitor, and a second electrode of the eighth transistor is connected to the reference voltage line.

7. The array substrate according to claim 6, wherein each of the plurality of pixel circuits is connected to a switch signal line and supplies a bias voltage to a light-emitting device in the pixel circuit under the control of a signal on the switch signal line;

wherein the scanning signal line corresponding to the pixel circuit closest to the second end of the data line is connected to the third control signal line; and wherein the scanning signal line corresponding to the pixel circuit second closest to the second end of the data line is connected to the fourth control signal line.

8. The array substrate according to claim 6, wherein the reference voltage line is configured to supply a predetermined reference voltage to the second electrode of the first transistor so that the first transistor works within a saturation region.

9. The array substrate according to claim 7, wherein the reference voltage line is configured to supply a predetermined reference voltage to the second electrode of the first transistor so that the first transistor works within a saturation region.

10. The array substrate according to claim 1, wherein the reference voltage line is configured to supply a predetermined reference voltage to the second electrode of the first transistor so that the first transistor works within a saturation region.

11. The array substrate according to claim 1, wherein the pixel circuit comprises:

a second capacitor;

a light-emitting device, wherein a second end of the light-emitting device is connected to a fifth bias voltage line;

a ninth transistor, wherein a control electrode of the ninth transistor is connected to the scanning signal line, a first electrode of the ninth transistor is connected to the data line, and a second electrode of the ninth transistor is connected to a first end of the second capacitor;

a tenth transistor, wherein a control electrode of the tenth transistor is connected to a switch signal line, a first electrode of the tenth transistor is connected to a fourth bias voltage line, and a second electrode of the tenth transistor is connected to the first end of the second capacitor;

an eleventh transistor, wherein a control electrode of the eleventh transistor is connected to the scanning signal line, a first electrode of the eleventh transistor is connected to an initial voltage signal line, and a second electrode of the eleventh transistor is connected to a second end of the second capacitor; and a twelfth transistor, wherein a control electrode of the twelfth transistor is connected to the second end of the second capacitor, a first electrode of the twelfth transistor is connected to the first end of the second capacitor, and a second electrode of the twelfth transistor is connected to a first end of the light-emitting device.

12. A display device comprising the array substrate according to claim 1.

13. The display device according to claim 12, wherein the constant current circuit further comprises:

a fourth transistor, wherein a control electrode of the fourth transistor is connected to a second control signal line, a first electrode of the fourth transistor is connected to the first end of the first capacitor, and a second electrode of the fourth transistor is connected to a first bias voltage line; and a fifth transistor, wherein a control electrode of the fifth transistor is connected to the second control signal line, a first electrode of the fifth transistor is connected to the second end of the first capacitor, and a second electrode of the fifth transistor is connected to a second bias voltage line.

* * * * *